US010751761B2

(12) United States Patent
Suemasa

(10) Patent No.: US 10,751,761 B2
(45) Date of Patent: Aug. 25, 2020

(54) SELF-CLEANING DEVICE AND SUBSTRATE PROCESSING APPARATUS

(71) Applicant: Ebara Corporation, Tokyo (JP)

(72) Inventor: Shuichi Suemasa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 232 days.

(21) Appl. No.: 15/902,304

(22) Filed: Feb. 22, 2018

(65) Prior Publication Data

US 2018/0250717 A1 Sep. 6, 2018

(30) Foreign Application Priority Data

Mar. 6, 2017 (JP) ..... 2017-042195

(51) Int. Cl.

| | |
|---|---|
| ***B24B 53/017*** | (2012.01) |
| ***B24B 53/007*** | (2006.01) |
| ***B08B 3/02*** | (2006.01) |
| ***B08B 1/00*** | (2006.01) |
| ***B08B 3/08*** | (2006.01) |
| ***B08B 1/04*** | (2006.01) |

(52) U.S. Cl.

CPC ..... *B08B 1/007* (2013.01); *B08B 1/001* (2013.01); *B08B 1/04* (2013.01); *B08B 3/02* (2013.01); *B08B 3/08* (2013.01); *B24B 53/007* (2013.01); *B24B 53/017* (2013.01)

(58) Field of Classification Search

CPC ..... B24B 3/007; B24B 53/017; B08B 1/007; B08B 1/001; B08B 3/02; B08B 1/08

USPC ..... 451/444

See application file for complete search history.

(56) References Cited

U.S. PATENT DOCUMENTS 4,476,601 A * 10/1984 Oka ..... B08B 1/007 15/77
5,685,039 A * 11/1997 Hamada ..... H01L 21/67046 15/88.2
5,894,622 A * 4/1999 Manfredi ..... B08B 1/00 15/102
6,158,075 A * 12/2000 Tanaka ..... B08B 1/007 15/102
6,290,780 B1 * 9/2001 Ravkin ..... H01L 21/67046 134/6
6,379,469 B1 * 4/2002 Tanaka ..... B08B 1/007 134/6
6,438,781 B1 * 8/2002 Ritchey, Jr. ..... B08B 1/04 134/140
6,651,284 B2 * 11/2003 Tseng ..... B08B 1/007 134/104.1
7,316,236 B2 * 1/2008 Hoser ..... A45D 27/46 134/135

(Continued)

FOREIGN PATENT DOCUMENTS

JP 2015-065379 A 4/2015

*Primary Examiner* — Eileen P Morgan

(74) *Attorney, Agent, or Firm* — Abelman, Frayne & Schwab

(57) ABSTRACT

A self-cleaning device of the present disclosure includes: a cleaning member configured to clean a cleaning tool that cleans a substrate; and an injection unit configured to inject a liquid toward the cleaning member or the cleaning tool. The cleaning member has a cleaning surface that cleans the cleaning tool when the cleaning tool is pressed thereagainst, and the cleaning surface is inclined with respect to a horizontal plane.

8 Claims, 3 Drawing Sheets

(56) References Cited

U.S. PATENT DOCUMENTS

| | | | | |
|---|---|---|---|---|
| 8,127,395 | B2 * | 3/2012 | Yoon | H01L 21/67046 134/6 |
| 9,824,903 | B2 * | 11/2017 | Ishibashi | H01L 21/67046 |
| 10,002,778 | B2 * | 6/2018 | Ishibashi | B08B 1/001 |
| 2002/0160701 | A1 * | 10/2002 | Fehr | B08B 1/04 451/283 |
| 2003/0111176 | A1 * | 6/2003 | Choi | B24B 53/017 156/345.12 |
| 2003/0236057 | A1 * | 12/2003 | Fujita | B24B 37/04 451/41 |
| 2006/0021642 | A1 * | 2/2006 | Sliwa, Jr. | B08B 3/02 134/184 |
| 2007/0042691 | A1 * | 2/2007 | Kim | B24B 53/017 451/444 |
| 2008/0173335 | A1 * | 7/2008 | Yoon | H01L 21/67028 134/62 |
| 2014/0331440 | A1 * | 11/2014 | Ishibashi | H01L 21/67046 15/302 |
| 2016/0059380 | A1 * | 3/2016 | Yamaguchi | H01L 21/67046 451/56 |

* cited by examiner

SELF-CLEANING DEVICE AND SUBSTRATE PROCESSING APPARATUS

CROSS-REFERENCE TO RELATED APPLICATIONS

This application is based on and claims priority from Japanese Patent Application No. 2017-042195, filed on Mar. 6, 2017, with the Japan Patent Office, the disclosure of which is incorporated herein in their entireties by reference.

TECHNICAL FIELD

The present disclosure relates to a self-cleaning device and a substrate processing apparatus.

BACKGROUND

In the related art, a substrate processing apparatus such as that disclosed in Japanese Laid-Open Patent Publication No. 2015-065379 is known. This substrate processing apparatus includes a polishing section configured to polish a substrate, a cleaning section configured to clean the polished substrate with a cleaning tool (roll sponge), and a self-cleaning device configured to clean the cleaning tool. Further, the self-cleaning device includes a cleaning member (cleaning plate) configured to clean the cleaning tool and an injection unit (pure water nozzle and chemical liquid nozzle) configured to inject the liquid.

In this self-cleaning device, it is possible to wash off dirt and the like attached to the cleaning tool by injecting a liquid toward the cleaning tool and pressing the cleaning tool against the cleaning member while rotating the cleaning tool.

SUMMARY

A self-cleaning device according to a first aspect of the present disclosure includes: a cleaning member configured to clean a cleaning tool that cleans a substrate; and an injection unit configured to inject a liquid toward the cleaning member or the cleaning tool. The cleaning member has a cleaning surface that cleans the cleaning tool when the cleaning tool is pressed thereagainst, and the cleaning surface is inclined with respect to a horizontal plane.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
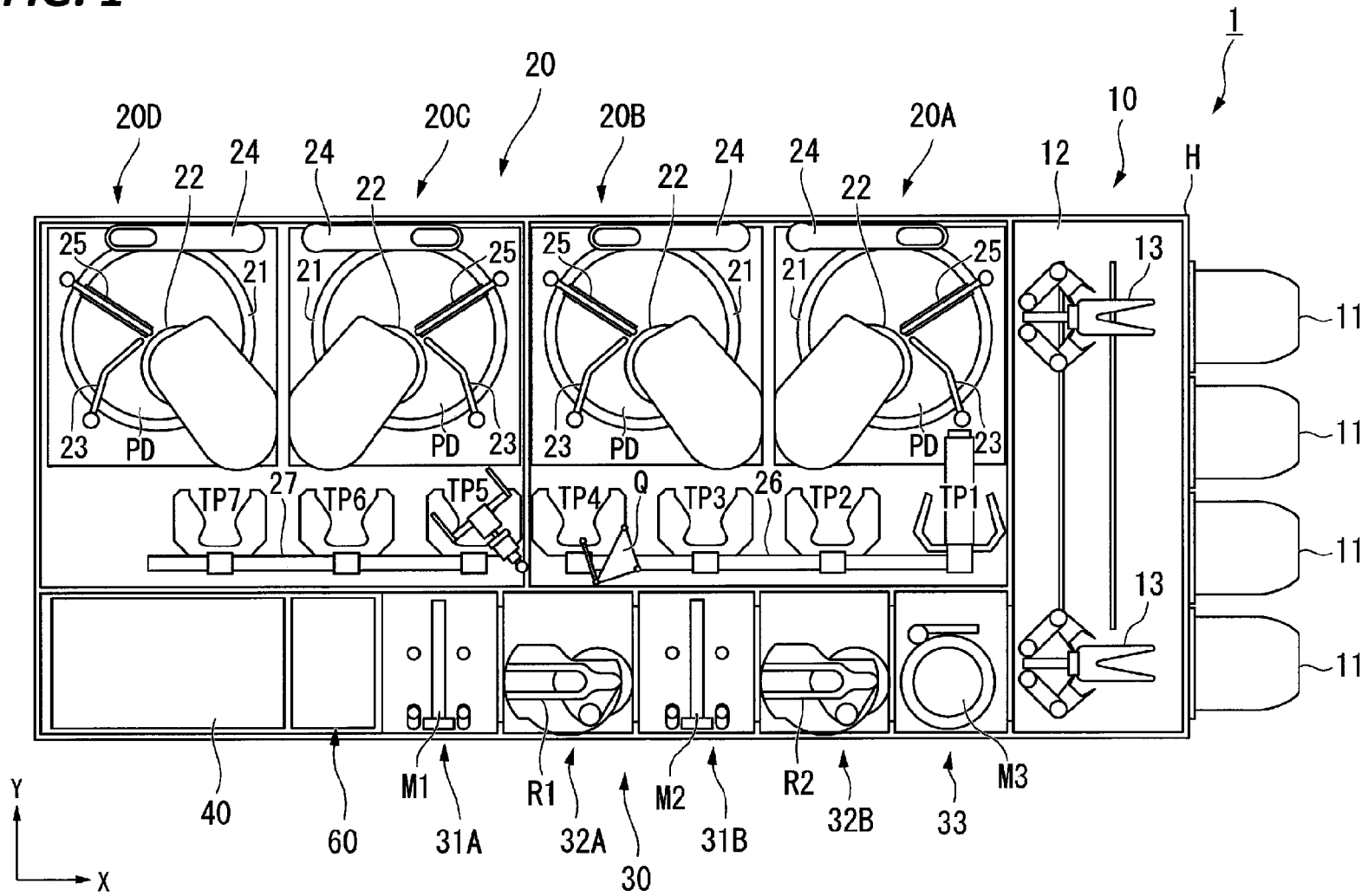
FIG. 1 is a plan perspective view of a substrate processing apparatus according to a first embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

In this type of self-cleaning device, a liquid such as a chemical liquid accumulates on the cleaning member so that the cleaning tool may not be thoroughly cleaned. When the cleaning tool by the self-cleaning device is insufficiently cleaned, the cleaning performance of the substrate by the cleaning tool may be deteriorated.

The present disclosure has been made in view of the foregoing circumstances, and provides a self-cleaning device capable of suppressing accumulation of a liquid such as a chemical liquid on a cleaning member.

In order to solve the above-described problem, a self-cleaning device according to a first aspect of the present disclosure includes: a cleaning member configured to clean a cleaning tool that cleans a substrate; and an injection unit configured to inject a liquid toward the cleaning member or the cleaning tool. The cleaning member has a cleaning surface that cleans the cleaning tool when the cleaning tool is pressed thereagainst, and the cleaning surface is inclined with respect to a horizontal plane.

According to the self-cleaning device of the above aspect, the cleaning surface of the cleaning member is inclined with respect to the horizontal plane. As a result, the liquid injected toward the cleaning member or the cleaning tool by the injection unit naturally falls from the cleaning surface by gravity. Therefore, it is possible to suppress accumulation of the liquid on the cleaning surface.

In addition, an inclination angle of the cleaning surface with respect to the horizontal plane may be 20° or more.

In this case, it is possible to more reliably suppress the accumulation of the liquid on the cleaning surface by setting the ratio of the area of the cleaning surface where the liquid accumulates to a predetermined amount or less.

Further, an angle formed by a direction in which the cleaning tool moves when the cleaning tool is pressed against the cleaning surface and a normal line of the cleaning surface may be 45° or less.

In this case, compared to a case where the angle formed by the normal line and the moving direction of the cleaning tool is larger than 45°, the cleaning tool may be reliably pressed against the cleaning surface and the cleaning tool may be cleaned more efficiently.

In order to solve the above-described problem, a substrate processing apparatus according to a second aspect of the present disclosure includes: a polishing section configured to polish a substrate; a cleaning section having a cleaning tool configured to clean the substrate; and a self-cleaning device configured to clean the cleaning tool.

According to the substrate processing apparatus of the above aspect, since the liquid is suppressed from accumulating on the cleaning surface of the cleaning member included in the self-cleaning device, it is possible to reliably wash off the dirt attached to the cleaning tool. This makes it possible to use the cleaning tool for a longer period of time or to clean the substrate more reliably using the cleaning tool.

According to the above aspect of the present disclosure, a liquid such as a chemical liquid may be suppressed from accumulating on the cleaning surface.

First Embodiment

Hereinafter, a configuration of the substrate processing apparatus 1 according to the first embodiment will be described with reference to FIGS. 1 to 4. Further, in each drawing used in the following description, the scale is appropriately changed in order to illustrate each member in a recognizable size.

In the present embodiment, the positional relationship of each configuration will be explained by setting an XYZ orthogonal coordinate system. The X direction is a direction of a substrate processing apparatus 1, the Z direction is a vertical direction thereof, and the Y direction is a direction orthogonal to both the X direction and the Z direction.

As illustrated in FIG. 1, the substrate processing apparatus 1 includes a substantially rectangular housing H partitioned into a loading/unloading section 10, a polishing section 20, and a cleaning section 30, and is a polishing device that performs a polishing process and a cleaning process (including a drying process) on a wafer (substrate).

Further, the substrate processing apparatus 1 includes a self-cleaning device 60 provided adjacent to the cleaning section 30.

The loading/unloading section 10 loads (carries in) a wafer to be processed into the substrate processing apparatus 1 and unloads (carries out) a processed wafer to the outside of the substrate processing apparatus 1. This loading/unloading section 10 includes a front loading part 11 and a loading/unloading unit 12. The front loading part 11 is a part on which a wafer cassette stocking a plurality of wafers therein is placed. In the present embodiment, four front loading parts 11 are provided. The front loading part 11 is configured to be capable of mounting a wafer cassette such as an open cassette, a standard manufacturing interface (SMIF) pod, or a front opening unified pod (FOUP).

The loading/unloading unit 12 is a unit that takes out a wafer to be processed from a wafer cassette placed on the front loading parts 11 and returns the processed wafer to the wafer cassette. The loading/unloading section 10 includes two transport robots (loaders) 13 configured to be movable along the arrangement of the front loading parts 11. These transport robots 13 move along the arrangement of the front loading parts 11 and are accessible to a wafer cassette mounted on a front loading part 11.

The polishing section 20 is a section in which a polishing process (flattening process) is processed on the wafer carried into the substrate processing apparatus 1. This polishing section 20 includes four polishing units arranged along the longitudinal direction of the substrate processing apparatus 1 (a first polishing unit 20A, a second polishing unit 20B, a third polishing unit 20C, and a fourth polishing unit 20D). These polishing units 20A to 20D each include a polishing table 21, a top ring 22, a polishing liquid supply nozzle 23, a dresser 24, and an atomizer 25.

A polishing pad PD having a polishing surface is attached to the polishing table 21. The top ring 22 polishes the wafer while pressing the wafer against the polishing pad PD on the polishing table 21. The polishing liquid supply nozzle 23 supplies a polishing liquid and a dressing liquid (e.g., pure water) to the polishing pad PD. The dresser 24 performs dressing of the polishing surface of the polishing pad PD. The atomizer 25 injects a mixed fluid of a liquid (e.g., pure water) and a gas (e.g., nitrogen gas), a misty liquid, or the like to the polishing surface of the polishing pad PD.

In addition, the polishing section 20 includes a first linear transporter 26 and a second linear transporter 27. The first linear transporter 26 is disposed adjacent to the first polishing unit 20A and the second polishing unit 20B, and transports the wafers among four transport positions illustrated in the drawings (a first transport position TP1, a second transport position TP2, a third transport position TP3, and a fourth transport position TP4). Further, a temporary placing table Q of the wafer is disposed between the first linear transporter 26 and the cleaning section 30.

The first transport position TP1 is a position where the first linear transporter 26 receives a wafer from the transport robot 13. The second transport position TP2 is a position where wafer delivery is performed between the top ring 22 of the first polishing unit 20A and the first linear transporter 26. The third transport position TP3 is a position where wafer delivery is performed between the top ring 22 of the second polishing unit 20B and the first linear transporter 26. The fourth transport position TP4 is a position where wafer delivery is performed between the second linear transporter 27 and the first linear transporter 26.

The second linear transporter 27 is disposed adjacent to the third polishing unit 20C and the fourth polishing unit 20D, and transports the wafer among three transport positions (a fifth transport position TP5, a sixth transport position TP6, and a seventh transport position TP7).

The fifth transport position TP5 is a position where wafer delivery is performed between the first linear transporter 26 and the second linear transporter 27. The sixth transport position TP6 is a position where wafer delivery is performed between the top ring 22 of the third polishing unit 20C and the second linear transporter 27. The seventh transport position TP7 is a position where wafer delivery is performed between the top ring 22 of the fourth polishing unit 20D and the second linear transporter 27.

The cleaning section 30 is a unit that performs a cleaning process and a drying process of the wafer polished by the polishing section 20. This cleaning section 30 includes five units arranged along the longitudinal direction of the substrate processing apparatus 1 (a first cleaning unit 31A, a first transport unit 32A, a second cleaning unit 31B, a second transport unit 32B, and a drying unit 33).

The first cleaning unit 31A and the second cleaning unit 31B each include cleaning tools M1 and M2 for cleaning the wafer. As for the cleaning tools M1 and M2, cylindrical rolls extending in the Y direction may be used. As for the materials of the cleaning tools M1 and M2, porous PVA sponge, urethane foam, or the like may be used.

The first cleaning unit 31A and the second cleaning unit 31B inject the chemical liquid toward the wafer and bring the outer peripheral surfaces of the cleaning tools M1 and M2 into contact with the wafer to rotate the cleaning tools M1 and M2 and clean the wafer. As for the chemical liquid, a mixed aqueous solution of ammonia/hydrogen peroxide (SC1) or the like may be used.

The first transport unit 32A and the second transport unit 32B each include vertically movable transport robots R1 and R2. The transport robot R1 transports the wafer between the temporary placing table Q and the first cleaning unit 31A, and between the first cleaning unit 31A and the second cleaning unit 31B. The transport robot R2 transports the wafer between the second cleaning unit 31B and the drying unit 33.

The drying unit 33 includes a drying module M3 for drying the wafer cleaned by the cleaning units 31A and 31B. This drying module M3 dries the wafer by, for example, Rotagoni drying. Here, the Rotagoni drying is a drying method in which a wafer is dried by supplying IPA vapor (a mixture of isopropyl alcohol and $N_2$ gas) and ultrapure water to the surface of the wafer while rotating the wafer.

Further, the substrate processing apparatus 1 includes a controller 40 that controls the operation of the substrate processing apparatus 1 inside the housing H in an integrated manner. This controller 40 controls the operation of the substrate processing apparatus 1 in an integrated manner by outputting control signals according to the detection results of various sensors provided in the substrate processing apparatus 1. For example, the controller 40 performs a control of adjusting the pressing force of the top ring 22 based on the detection results of the film thickness sensors of the polishing units 20A to 20D or cleaning the cleaning tool M1 with the self-cleaning device 60 at a predetermined timing.

The self-cleaning device 60 is a device for cleaning the cleaning tool M1. The cleaning tool M1 is moved from the cleaning section 30 to the self-cleaning device 60 at a predetermined timing (see FIG. 2).

Figure 3:
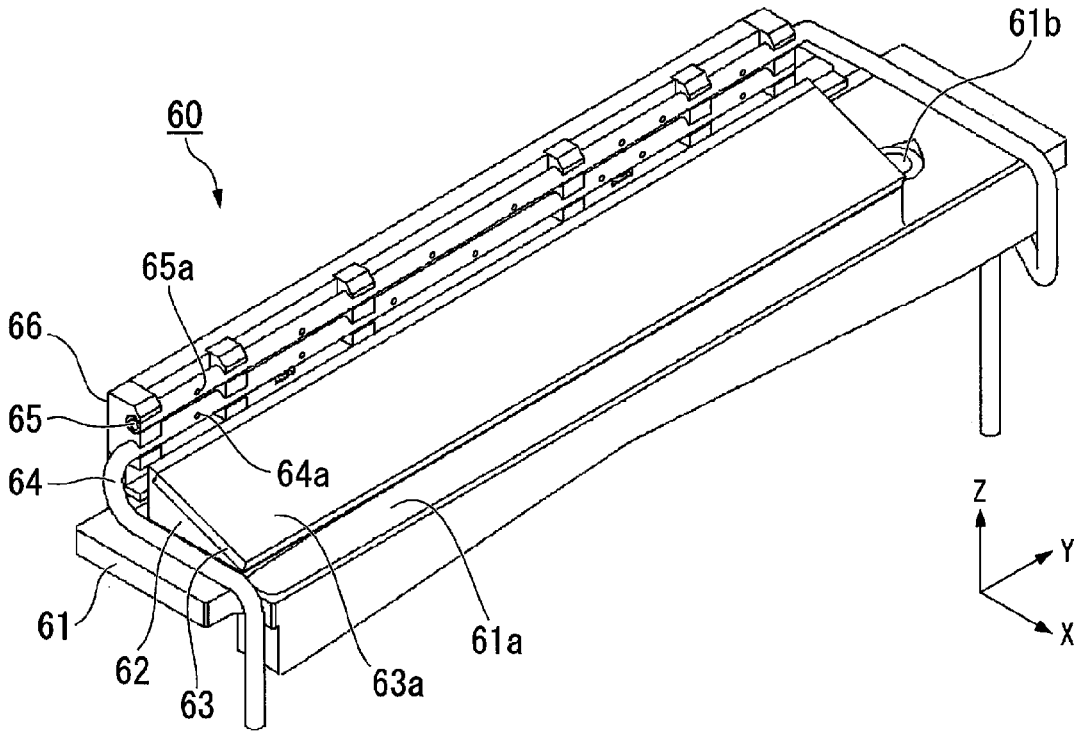
FIG. 3 is a perspective view of the self-cleaning device of FIG. 1.

As illustrated in FIG. 3, the self-cleaning device 60 includes a base 61, a tilting table 62, a cleaning member 63, a chemical liquid pipe 64, a water pipe 65, and a pipe support 66. In addition, the self-cleaning device 60 is generally longer in the Y direction than in the X direction. Therefore, the Y direction is the longitudinal direction of the self-cleaning device 60.

The base 61 supports the tilting table 62 and the pipe support 66. A drain port 61*a* extending along the Y direction is formed on the base 61. The bottom surface of the drain port 61*a* gradually extends downward toward one side in the Y direction. Further, a drain port 61*b* is formed at one end of the drain port 61*a* in the Y direction. Therefore, the liquid in the drain port 61*a* naturally flows toward one side in the Y direction by gravity and is drained from the drain port 61*b*.

The tilting table 62 is fixed on the base 61. The cleaning member 63 is fixed to the tilting table 62.

The cleaning member 63 is adjacent to the drain port 61*a* in the X direction and is disposed above the drain port 61*a*. The cleaning member 63 is formed in a rectangular plate shape that is long in the Y direction and short in the X direction. The upper surface of the cleaning member 63 is a cleaning surface 63*a* for cleaning the cleaning tool M1 when the cleaning tool M1 is pressed thereagainst. The cleaning surface 63*a* gradually extends downward toward the drain port 61*a* side in the X direction. That is, the cleaning surface 63*a* is inclined toward the drain port 61*a*.

The cleaning member 63 is formed of quartz. Further, the material and shape of the cleaning member 63 may be appropriately changed according to the material, shape, and the like of the cleaning tool M1. For example, polyvinyl chloride (PVC) may be adopted as the material of the cleaning member 63.

The chemical liquid pipe 64 and the water pipe 65 extend in the Y direction and are supported by the pipe support 66. The water pipe 65 is positioned above the chemical liquid pipe 64. The chemical liquid pipe 64 includes an injection hole (injection portion) 64*a* formed to inject the chemical liquid flowing in the chemical liquid pipe 64. A plurality of injection holes 64*a* are formed on a side surface of the chemical liquid pipe 64 at intervals along the extending direction of the chemical liquid pipe 64. An injection hole (injection portion) 65*a* for injecting pure water flowing in the water pipe 65 is formed in the water pipe 65. A plurality of injection holes 65*a* are formed on a side surface of the water pipe 65 at intervals along the extending direction of the water pipe 65.

Next, the operation of the substrate processing apparatus 1 having the above configuration will be described.

The wafers taken out by the transport robot 13 from the front loading part 11 are sequentially polished by the first polishing unit 20A and the second polishing unit 20B and placed on the temporary placing table Q. Similarly, some of the wafers are sequentially polished by the third polishing unit 20C and the fourth polishing unit 20D and placed on the temporary placing table Q. In this way, the substrate processing apparatus 1 may perform a polishing process on a plurality of wafers in parallel.

The wafers placed on the temporary placing table Q are sequentially transported to the first cleaning unit 31A and the second cleaning unit 31B by the first transport unit 32A provided in the cleaning section 30, and sequentially cleaned by the first cleaning unit 31A and the second cleaning unit 31B. The cleaned wafers are transported to the drying unit 33 by the second transport unit 32B and dried. The wafers dried by the drying unit 33 are returned to the wafer cassette of the front loading part 11 by the transport robot 13.

As the wafers are cleaned, dirt adheres to the cleaning tool M1. Therefore, the cleaning tool M1 is moved to and cleaned by the self-cleaning device 60 at a predetermined timing.

In the present embodiment, the cleaning tool M1 is rotated and pressed against the cleaning member 63 and the chemical liquid is injected toward the cleaning tool M1 to remove dirt adhering to the cleaning tool M1. At this time, the rotational direction of the cleaning tool M1 may be either CW rotation or CCW rotation in the front view illustrated in FIG. 4. Further, the number of rotations of the cleaning tool M1 may be equal to or different from the number of rotations at the time of cleaning the wafers. In addition, the rotation of the cleaning tool M1 may be performed only while the cleaning tool M1 is pressed against the cleaning member 63, and may be executed continuously even while the cleaning tool M1 is being moved between the cleaning section 30 and the self-cleaning device 60.

After rotating the cleaning tool M1 in the state of being pressed against the cleaning member 63 by a predetermined amount, the cleaning tool M1 is raised and retreated from the cleaning member 63, and pure water is injected toward the cleaning member 63 and the cleaning tool M1 so as to remove the dirt of the cleaning member 63 and the cleaning tool M1.

Further, the chemical liquid injected from the injection hole 64*a* of the chemical liquid pipe 64 may be the same as the chemical liquid used for cleaning the wafer in the cleaning units 31A and 31B. In addition, the chemical liquid and pure water are used, but one or three or more types of liquids may be used to wash the cleaning tool M1 and the cleaning member 63. Further, pure water may not be used for cleaning the cleaning tool M1, but may be used only for cleaning the cleaning member 63.

Here, the chemical liquid or pure water used for cleaning the cleaning tool M1 or the cleaning member 63 contains dirt, which has adhered to the cleaning tool M1. Therefore, when the liquid mixed with the dirt accumulates on the cleaning surface 63*a*, there is a possibility that the cleaning tool M1 is contaminated again. Further, when the liquid containing the chemical liquid or the like accumulates on the cleaning surface 63*a* for a long time, there is a possibility that the cleaning performance of the cleaning tool M1 by the self-cleaning device 60 may be affected due to change of the liquid or the like. From the foregoing, the liquid used for cleaning the cleaning tool M1 may be quickly separated from the cleaning surface 63*a*.

Figure 4:
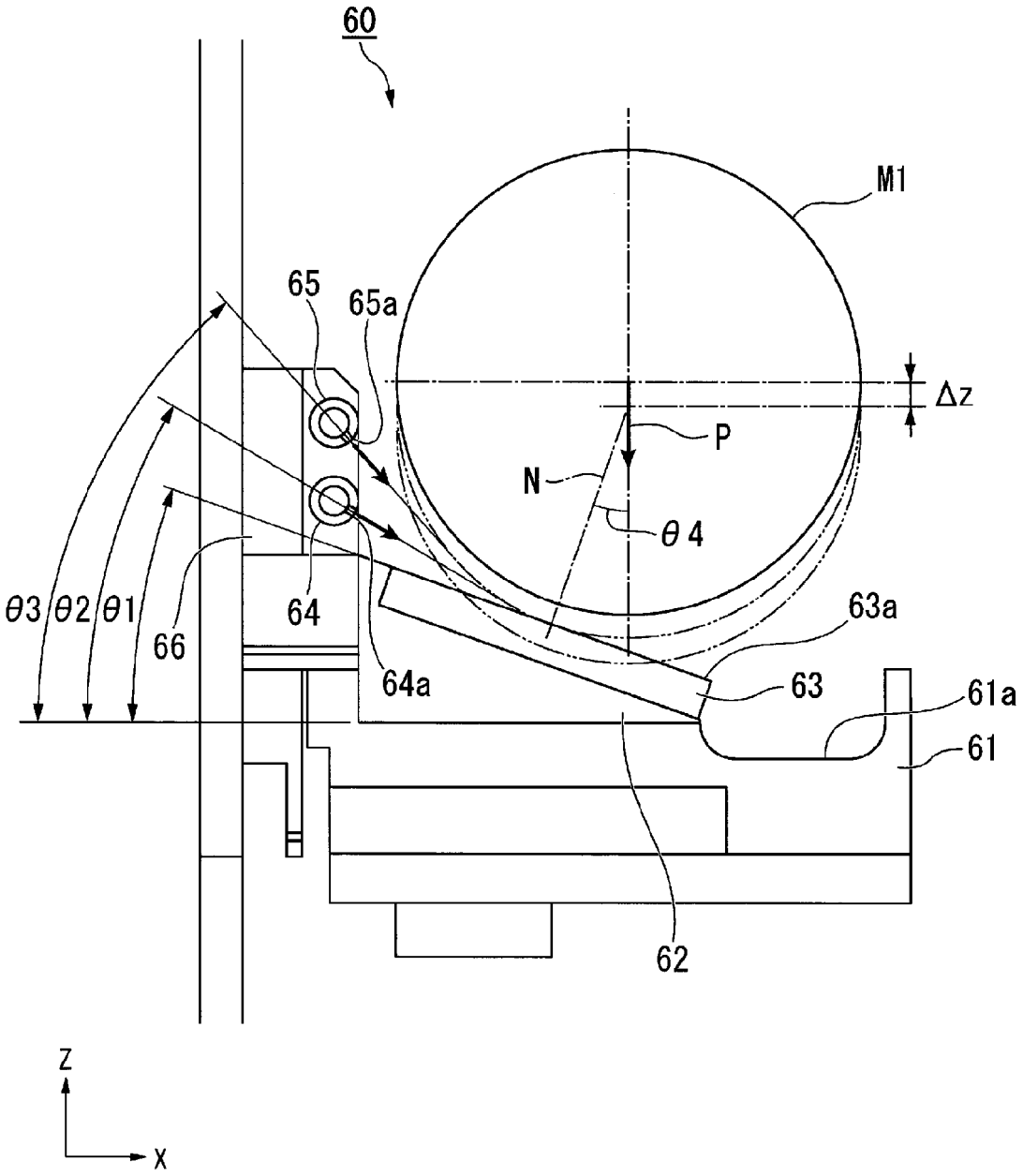
FIG. 4 is a cross-sectional view of the self-cleaning device of FIG. 1.

Therefore, in the present embodiment, as illustrated in FIG. 4, the cleaning surface 63*a* is inclined with respect to a horizontal plane (a plane orthogonal to the vertical direction). Therefore, the liquid used for cleaning the cleaning tool M1 or the cleaning member 63 flows down on the cleaning surface 63*a*. As a result, it is possible to suppress the liquid from staying on the cleaning surface 63*a* for a long time. Further, the liquid that drops from the cleaning surface 63*a* flows through the drain port 61*a* and is drained from the drain port 61*b*.

In the following description, as illustrated in FIG. 4, an angle of the cleaning surface 63*a* with respect to the horizontal plane is referred to as an inclination angle θ1.

The water drainage performance of the liquid on the cleaning surface 63*a* may be evaluated by the ratio of the area of the portion where the liquid accumulates to the area of the cleaning surface 63*a*. As a result of intensive review by the present inventors, when the inclination angle θ1 is 20° or more, the ratio was able to be set as equivalent to that in the case where the inclination angle θ1 is 90° (when the cleaning surface 63*a* is vertically erected with respect to the horizontal plane). Further, the above ratio at this time was 5% or less. Therefore, the inclination angle θ1 may be 20° or more.

Further, when the direction in which the cleaning tool M1 moves when the cleaning tool M1 is pressed against the cleaning surface 63*a* is defined as the moving direction P, and the normal line of the plane in which the cleaning surface 63*a* extends is defined as the normal line N, the pressing angle θ4 between the moving direction P and the normal line N may be 45° or less. This is because when the pressing angle θ4 exceeds 45°, the loss of the force for pressing the cleaning tool M1 against the cleaning surface 63*a* increases, and the efficiency of cleaning the cleaning tool M1 decreases.

Further, in the present embodiment, since the moving direction P and the vertical direction P coincide with each other, the pressing angle θ4 and the inclination angle θ1 also coincide with each other. Therefore, when the pressing angle θ4 is 45° or less, the inclination angle θ1 also becomes 45° or less.

From the foregoing, the inclination angle θ1 may be in the range of 20° to 45°.

Further, ΔZ illustrated in FIG. 4 indicates an amount of movement (amount of descent) of the cleaning tool M1 from the standby position before the self-cleaning operation to the pressing position during the self-cleaning. ΔZ is, for example, about 3 mm. When ΔZ is 3 mm, the pressing amount of the cleaning tool M1 against the cleaning surface 63*a* is 2.8 mm.

Further, as illustrated in FIG. 4, when the injection angle of the chemical liquid injected from the injection hole 64*a* of the chemical liquid pipe 64 with respect to the horizontal plane is θ2, θ2 is, for example, about 31°. In addition, when the injection angle of pure water injected from the injection hole 65*a* of the water pipe 65 with respect to the horizontal plane is θ3, θ3 is, for example, about 49°. These angles θ2 and θ3 may be appropriately changed.

As described above, according to the self-cleaning device 60 of the present embodiment, the cleaning surface 63*a* of the cleaning member 63 is inclined with respect to the horizontal plane. As a result, the liquid injected toward the cleaning member 63 or the cleaning tool M1 naturally falls from the cleaning surface 63*a* by gravity. Therefore, it is possible to suppress the accumulation of the liquid on the cleaning surface 63*a*.

Further, by setting the inclination angle θ1 to 20° or more and adjusting the ratio of the area where the liquid accumulates to be equal to or less than a predetermined amount (e.g., 5% or less), it is possible to more reliably suppress the accumulation of the liquid on the cleaning surface 63*a*.

In addition, by setting the pressing angle θ4 to 45° or less, it is possible to more reliably clean the cleaning tool M1 by reliably pressing the cleaning tool M1 against the cleaning surface 63*a*.

Further, according to the substrate processing apparatus 1 of the present embodiment, the accumulation of the liquid on the cleaning surface 63*a* is suppressed so as to be able to reliably wash off the dirt adhering to the cleaning tool M1. Due to this, it is possible to make the cleaning tool M1 usable for a longer period of time or more reliably clean the wafer using the cleaning tool M1.

The technical scope of the present disclosure is not limited to the above embodiment, and various modifications may be made without departing from the spirit of the present disclosure.

For example, in the above-described embodiment, the plate-like cleaning member 63 is fixed to the tilting table 62, but the cleaning member and the tilting table 62 may be integrated. In this case, the cleaning member may have a mounting surface extending horizontally and attached to the base 61, and a cleaning surface inclined with respect to the mounting surface.

In addition, in the above-described embodiment, liquid is injected from the injection holes 64*a* and 65*a* formed in the chemical liquid pipe 64 and the water pipe 65, but another type of injection unit may be adopted.

Figure 2:
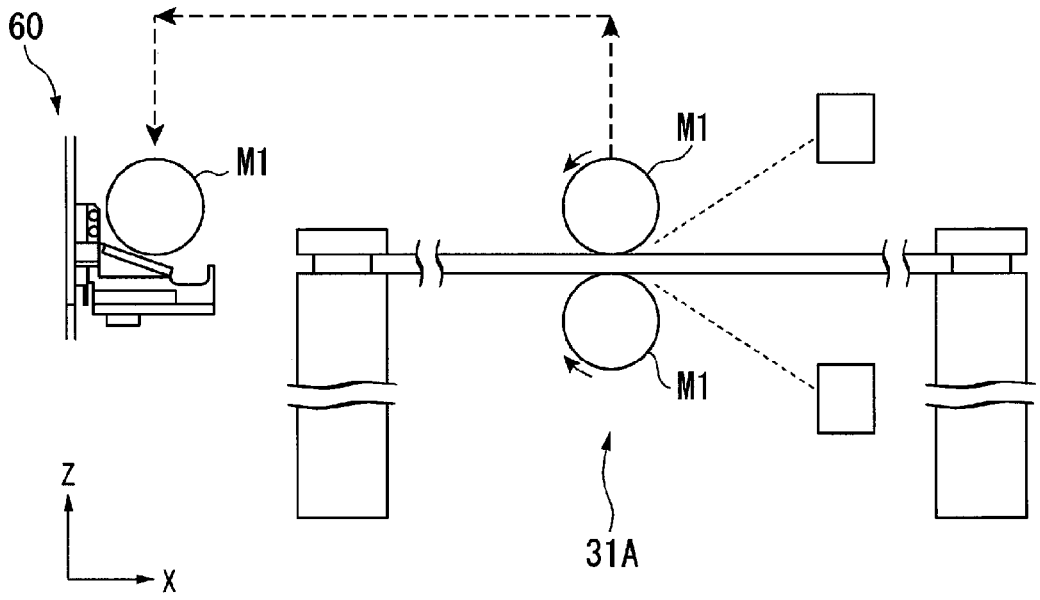
FIG. 2 is an explanatory view of the self-cleaning device of FIG. 1.

Further, although the self-cleaning device 60 for cleaning the upper side cleaning tool M1 is illustrated in FIG. 2, the self-cleaning device 60 for cleaning the lower side cleaning tool M1 may be separately provided. Alternatively, the self-cleaning device 60 in FIG. 2 may clean both the upper and lower cleaning tools M1. Similarly, the self-cleaning device 60 for cleaning the cleaning tool M2 of the second cleaning unit 31B may be separately provided, and the self-cleaning device 60 of FIG. 1 may clean both the cleaning tool M1 and the cleaning tool M2.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A self-cleaning device comprising:

a base;

a cleaning member having a first end and a second end opposite to the first end, the cleaning member having a cleaning surface thereon, the cleaning member being formed in a rectangular plate shape and configured to clean a cleaning tool that cleans a substrate by rotating and pressing the cleaning tool against the cleaning surface;

a tilting table fixed on the base and attached to the cleaning member, the tilting table fixing the cleaning member so that the cleaning surface is fixedly inclined in a Z direction with respect to a horizontal plane such that the first end of the cleaning member is raised relative to the second end of the cleaning member and the second end of the cleaning member is attached to the base; and a liquid injector positioned above the cleaning member and adjacent to the first end of the cleaning member, the liquid injector being configured to inject a liquid toward the cleaning member and the cleaning tool.

2. The self-cleaning device of claim 1, wherein an inclination angle with respect to the horizontal plane of the cleaning surface is 20° or more.

3. The self-cleaning device of claim 1, wherein an angle formed by a direction in which the cleaning tool moves when the cleaning tool is pressed against the cleaning surface and a normal line of the cleaning surface is 45° or less.

4. The self-cleaning device of claim 1, wherein the base has a drain port formed therein, the drain port being positioned adjacent to the second end of the cleaning surface and extends along the second end of the cleaning surface in a direction parallel to the second end of the cleaning surface.

5. A substrate processing apparatus comprising:

a polishing section configured to polish a substrate;

a cleaning section having a cleaning tool configured to clean the substrate; and a self-cleaning device that cleans the cleaning tool, wherein the self-cleaning device comprises:

a base;

a cleaning member having a first end and a second end opposite to the first end, the cleaning member having a cleaning surface thereon, the cleaning member being formed in a rectangular plate shape and configured to clean a cleaning tool that cleans a substrate by rotating and pressing the cleaning tool against the cleaning surface;

a tilting table fixed on the base and attached to the cleaning member, the tilting table fixing the cleaning member so that the cleaning surface is fixedly inclined in a Z direction with respect to a horizontal plane such that the first end of the cleaning member is raised relative to the second end of the cleaning member and the second end of the cleaning member is attached to the base; and a liquid injector positioned above the cleaning member and adjacent to the first end of the cleaning member, the liquid injector being configured to inject a liquid toward the cleaning member and the cleaning tool.

6. The substrate processing apparatus of claim 5, wherein an inclination angle with respect to the horizontal plane of the cleaning surface is 20° or more.

7. The substrate processing apparatus of claim 5, wherein an angle formed by a direction in which the cleaning tool moves when the cleaning tool is pressed against the cleaning surface and a normal line of the cleaning surface is 45° or less.

8. The substrate processing apparatus of claim 5, wherein the base has a drain port formed therein, the drain port being positioned adjacent to the second end of the cleaning surface and extends along the second end of the cleaning surface in a direction parallel to the second end of the cleaning surface.

* * * * *